US007381160B2

(12) United States Patent
Lo

(10) Patent No.: US 7,381,160 B2
(45) Date of Patent: Jun. 3, 2008

(54) FOLDING AND SUPPORTING DEVICE FOR TREADMILLS

(76) Inventor: Chiu-Hsiang Lo, No. 20, Lane305, Sec.3, Chung-Sun Rd., Tan-Tz Shiang, Taichung Hsien (TW)

( * ) Notice: Subject to any disclaimer, the term of this patent is extended or adjusted under 35 U.S.C. 154(b) by 186 days.

(21) Appl. No.: 11/155,640

(22) Filed: Jun. 20, 2005

(65) Prior Publication Data

US 2006/0287162 A1 Dec. 21, 2006

(51) Int. Cl.
*A63B 22/00* (2006.01)
*A63B 21/00* (2006.01)

(52) U.S. Cl. ..... 482/54; 482/51

(58) Field of Classification Search ..... 482/51, 482/54; 119/700; 434/247
See application file for complete search history.

(56) References Cited

U.S. PATENT DOCUMENTS 5,868,648 A * 2/1999 Coody et al. ..... 482/54
6,884,201 B2 * 4/2005 Wu ..... 482/54
6,984,193 B2 * 1/2006 Chen ..... 482/54
2003/0139263 A1 * 7/2003 Wu et al. ..... 482/54
2004/0132585 A1 * 7/2004 Chen ..... 482/54
2004/0266589 A1 * 12/2004 Tsou ..... 482/54
2005/0096187 A1 * 5/2005 Hsu ..... 482/54
2006/0058160 A1 * 3/2006 Lee et al. ..... 482/54
2006/0122037 A1 * 6/2006 Chou Lin ..... 482/54

* cited by examiner

*Primary Examiner*—Glenn Richman
(74) *Attorney, Agent, or Firm*—WPAT, P.C.; Anthony King

(57) ABSTRACT

A treadmill includes a base and a frame has a first end thereof pivotably connected to the base and an endless belt is connected to the frame. A guide rod has its axis extending lengthwise of the frame and a first end of the guide rod is fixed to the base. A second end of the guide rod connected to the base. A sleeve extends through a through hole in a transverse bar of the base 10 and the guide rod is received in the sleeve which is able to move along the guide rod back and forth. A supporting rod has a first end thereof pivotably connected to a pivotal portion on the sleeve and a second end of the supporting rod is pivotably connected to a first pivotal portion on the frame. A securing device is connected to the sleeve so as to secure movement of the sleeve relative to the guide rod so that the frame can be kept at upright position.

5 Claims, 10 Drawing Sheets

FOLDING AND SUPPORTING DEVICE FOR TREADMILLS

FIELD OF THE INVENTION

The present invention relates to a folding and supporting device for treadmills and a securing device is used to position the folding and supporting device when the frame is folded at upright position.

BACKGROUND OF THE INVENTION

A conventional treadmill is shown in FIG. 12 and generally includes a base 70 and a frame 71 on which an endless belt 72 is connected to the frame 71 so that the users run on the endless belt 72. The endless belt 72 can also be driven by a motor which allows the users to set pre-determined speed of the endless belt 72 to meet different requirements of the users. In order to save space of storage of the treadmill, the length "L" of the base 70 is usually designed to be shorter than the frame 71 and the frame 71 is pivoted relative to the base 70. When the frame 71 is folded to upright position, a securing device is used to hold the frame 71. Nevertheless, the base 70 might be pivoted clockwise about the rear point 700 if the users use too much force and this is because the length "L" of the base 70 is too short. The unstable base 70 could result a dangerous injury to the users.

The present invention intends to provide a folding and supporting device to easily folding the frame of treadmills and the frame can be kept at position by a securing device.

SUMMARY OF THE INVENTION

The present invention relates to a treadmill that comprises a base and a frame has a first end thereof pivotably connected to the base. An endless belt is connected to the frame. A guide rod has its axis extending lengthwise of the frame and a first end of the guide rod is fixed to the base. A second end of the guide rod is connected to the base at a position corresponding to a through hole defined in the base. A sleeve extends through the through hole of the base and the guide rod is inserted in the sleeve which moves along the guide rod back and forth. A supporting rod has a first end thereof pivotably connected to a second pivotal portion on the sleeve and a second end of the supporting rod is pivotably connected to a first pivotal portion of the frame. A securing device is connected to the sleeve so as to secure movement of the sleeve relative to the guide rod.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
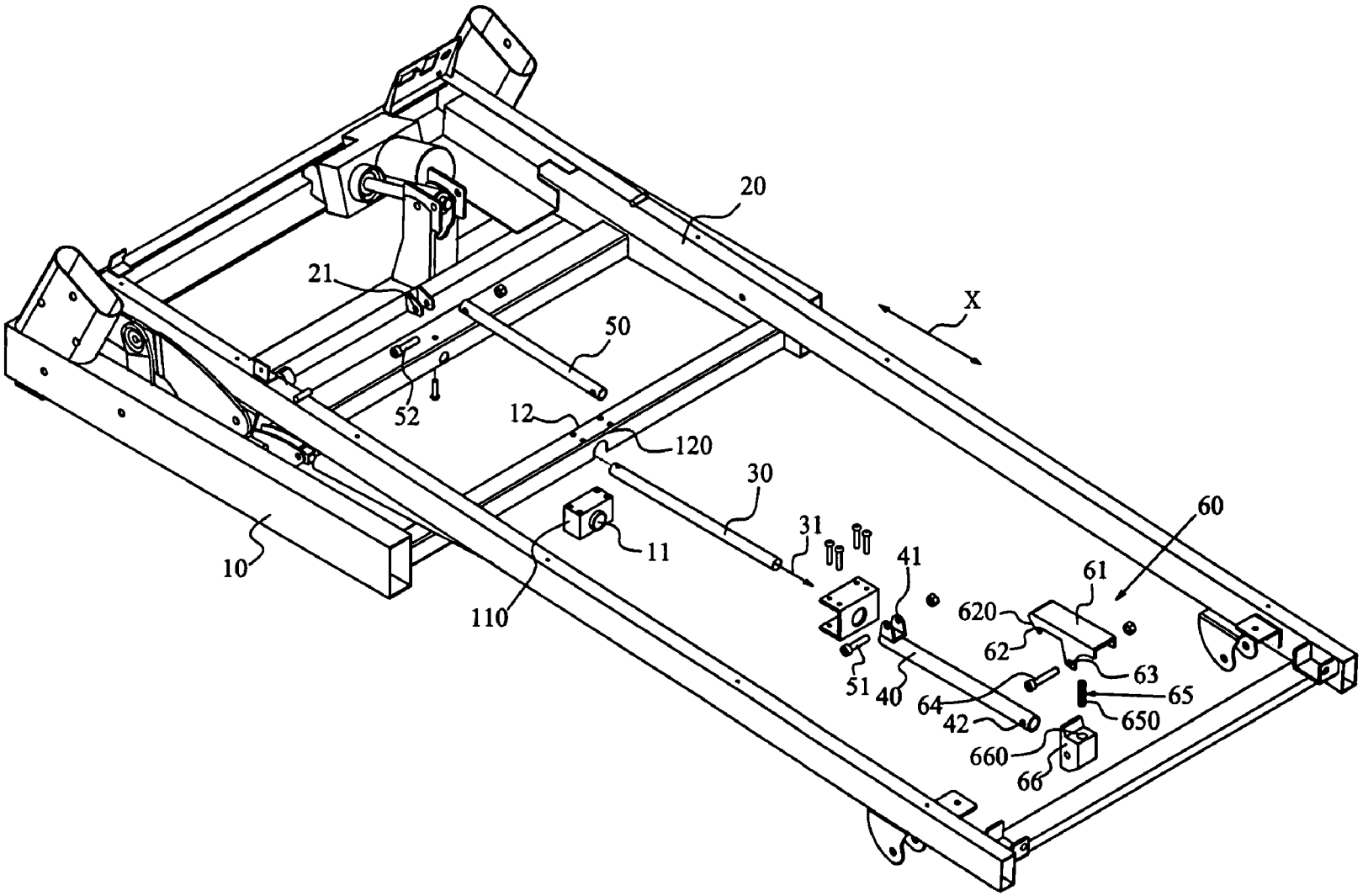
FIG. 1 is an exploded view to show the folding and supporting device of the present invention.
Figure 2:
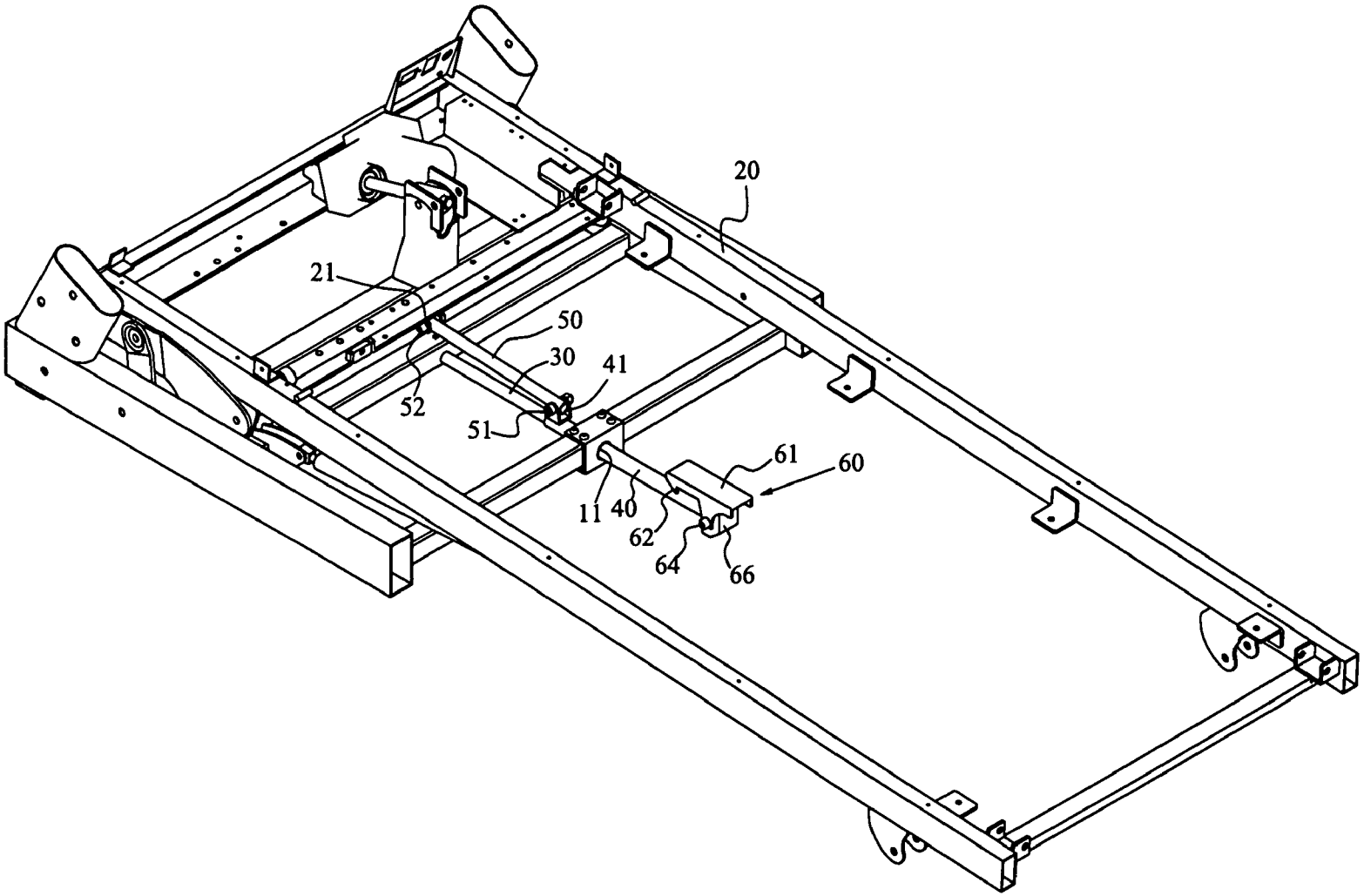
FIG. 2 is a perspective view to show that the folding and supporting device of the present invention is connected to a treadmill.
Figure 3:
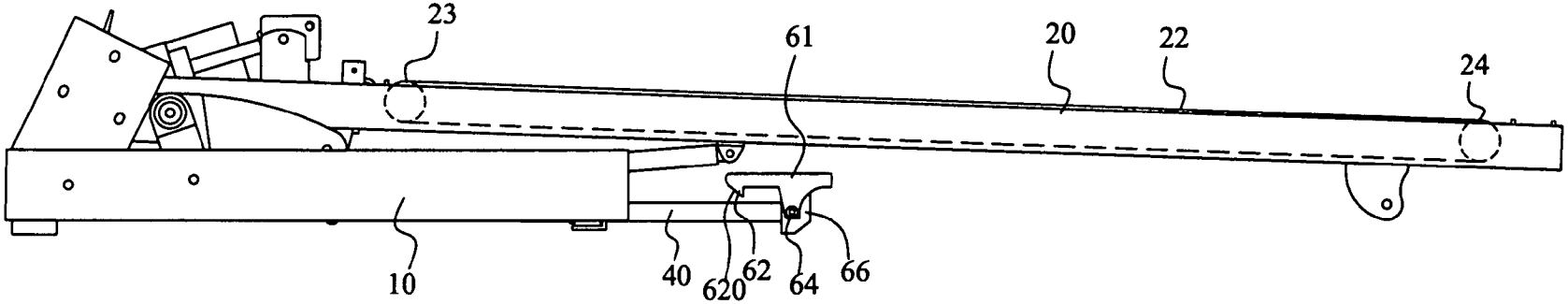
FIG. 3 is a side view of the treadmill in FIG. 2.

Referring to FIGS. 1 to 3, the treadmill of the present invention comprises a base 10 having a box 110 connected to one of several transverse bars of the base 10 and a through hole 11 is defined through the box 110. A frame 20 has a first end thereof pivotably connected to the base 10 and two rollers 23, 24 are connected to two ends of the frame 20 so that an endless belt 22 reeves through the two rollers 23, 24. The frame 20 has a first pivotal portion 21.

A guide rod 30 has its axis extending lengthwise (as indicated by "X") of the frame 20 and a first end of the guide rod 30 is fixed to the base 10. A second end of the guide rod 30 is connected to the base 10 at a position corresponding to the through hole 11.

A sleeve 40 extends through the through hole 11 of the box 110 and the guide rod 30 is inserted in the sleeve 40 which moves along the guide rod 30 back and forth. The sleeve 40 has a second pivotal portion 41. The guide rod 30 is a cylindrical rod and the sleeve 40 has a circular inner periphery so that the guide rod 30 can be movably inserted in the sleeve 40.

A supporting rod 50 has a first end thereof pivotably connected to the second pivotal portion 41 on the sleeve 40 by a pin 51 and a second end of the supporting rod 50 is pivotably connected to the first pivotal portion 21 of the frame 20 by another pin 52.

A securing device 60 is connected to the sleeve 40 and includes an engaging member 61 which is pivotably connected to the sleeve 40 by extending yet another pin 64 through a hole 63 defined in a first end of the engaging member 61 and a second hole 42 defined in the sleeve 40. The engaging member 61 has a hook end 62 at a second end thereof. A resilient member 65, such as a compression spring 650 is located between the engaging member 61 and the sleeve 40. A positioning member 66 is connected to the sleeve 40 and has a chamber 660 defined therein. The compression spring 650 has a first end thereof received in the chamber 660 and a second end of the compression spring 650 is in contact with the first end of the engaging member 61. By the compression spring 650, the hook end 62 is kept to face the hooked area 120 in the base 10.

Figure 4:
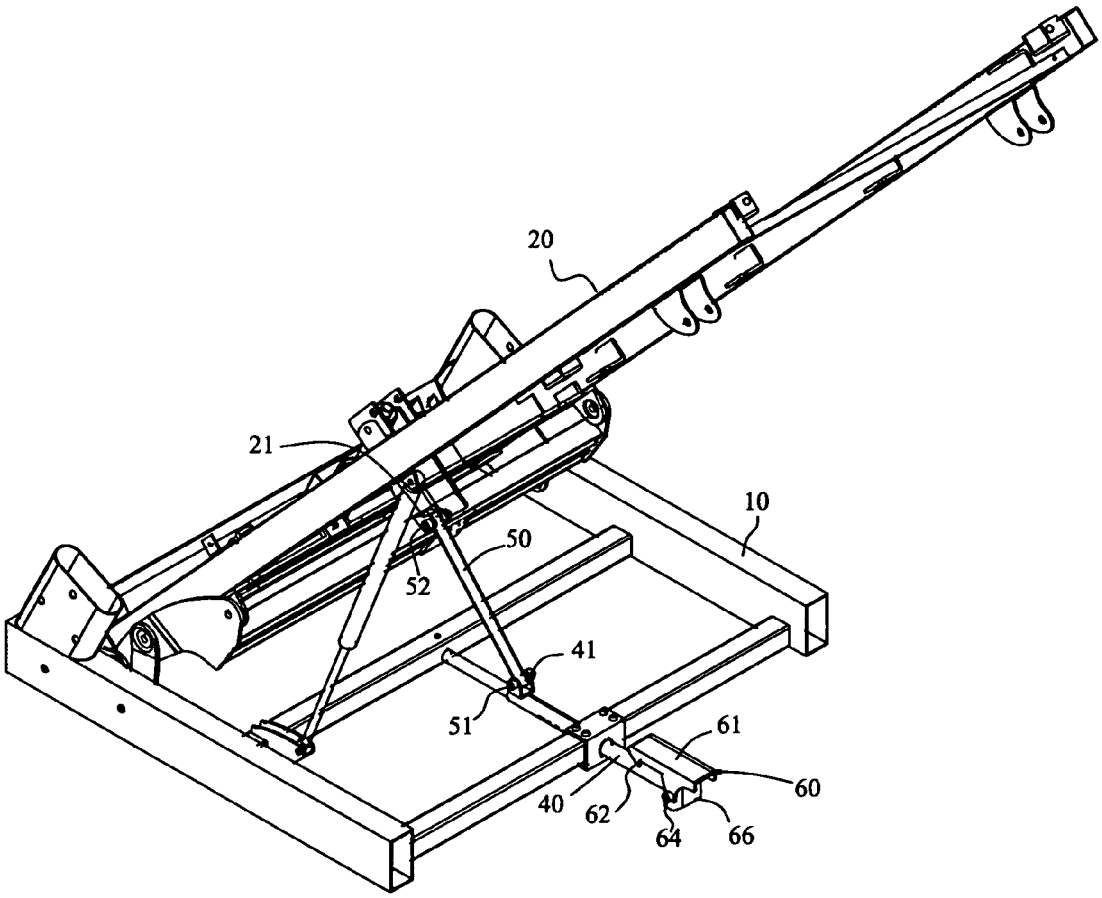
FIG. 4 shows the frame is pivoted relative to the base of the treadmill.
Figure 5:
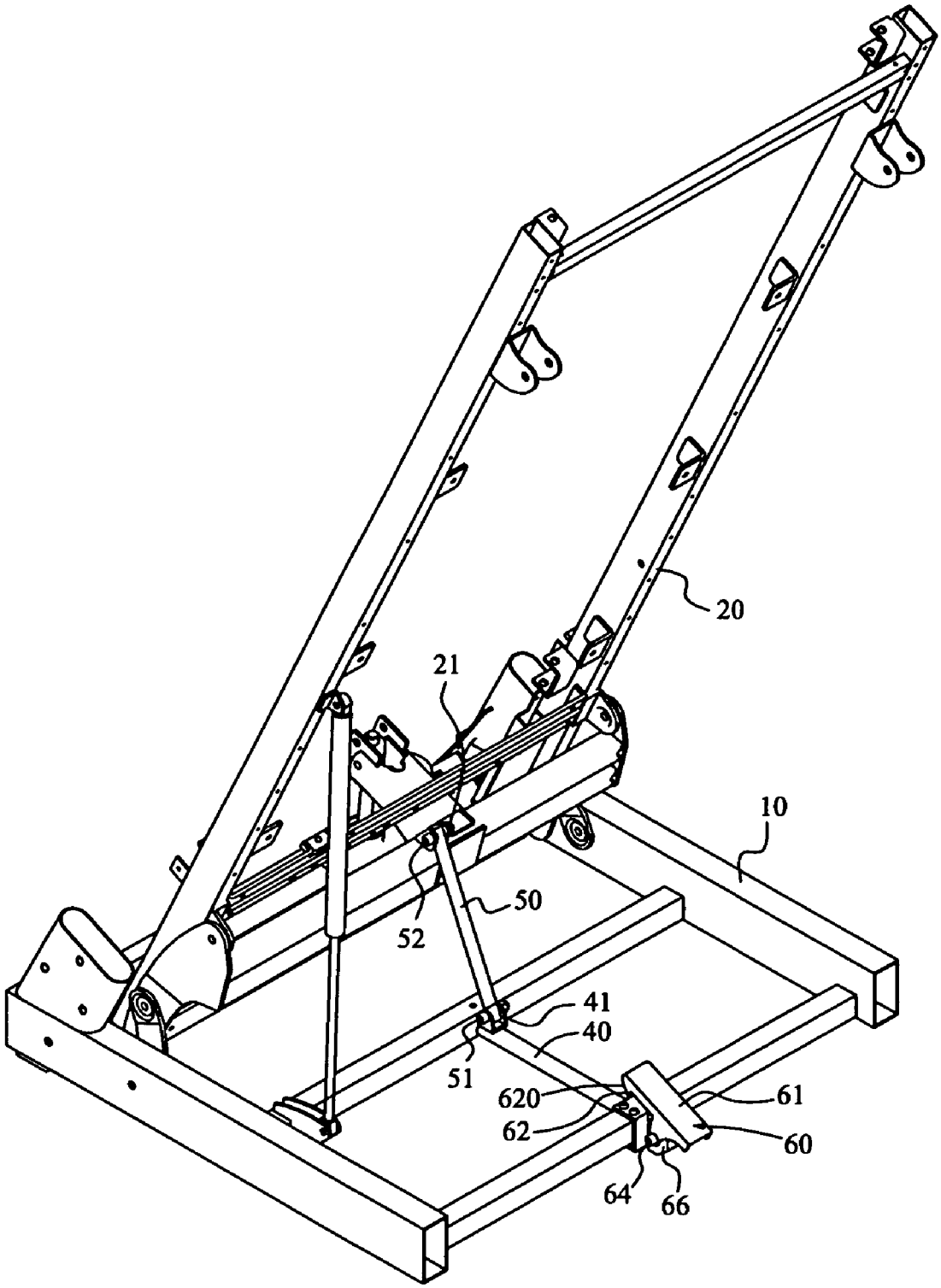
FIG. 5 shows that the frame is about to pivoted to an upright position relative to the base of the treadmill.
Figure 7:
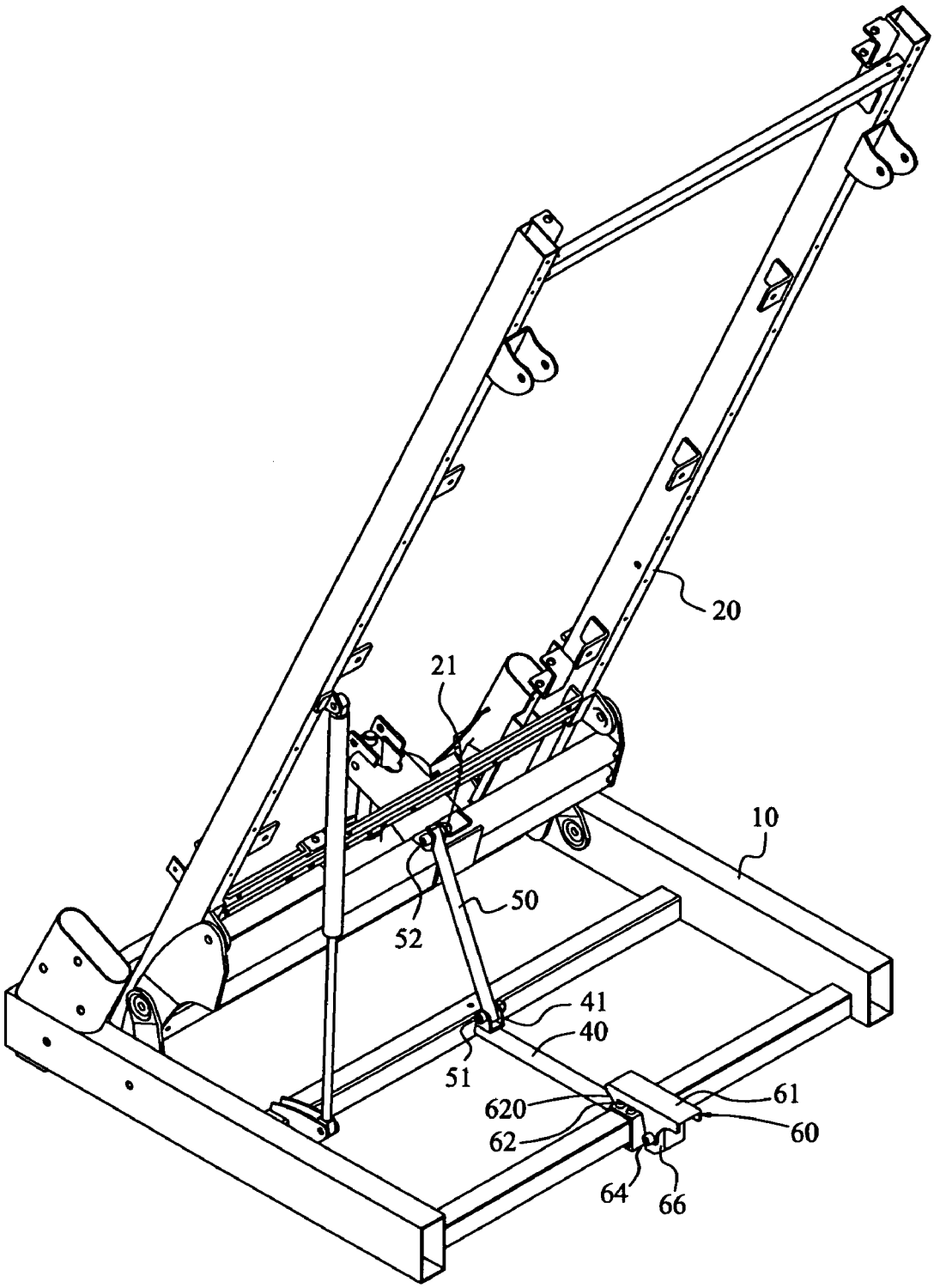
FIG. 7 shows that the engaging member is hooked to the transverse bar of the base.
Figure 8:
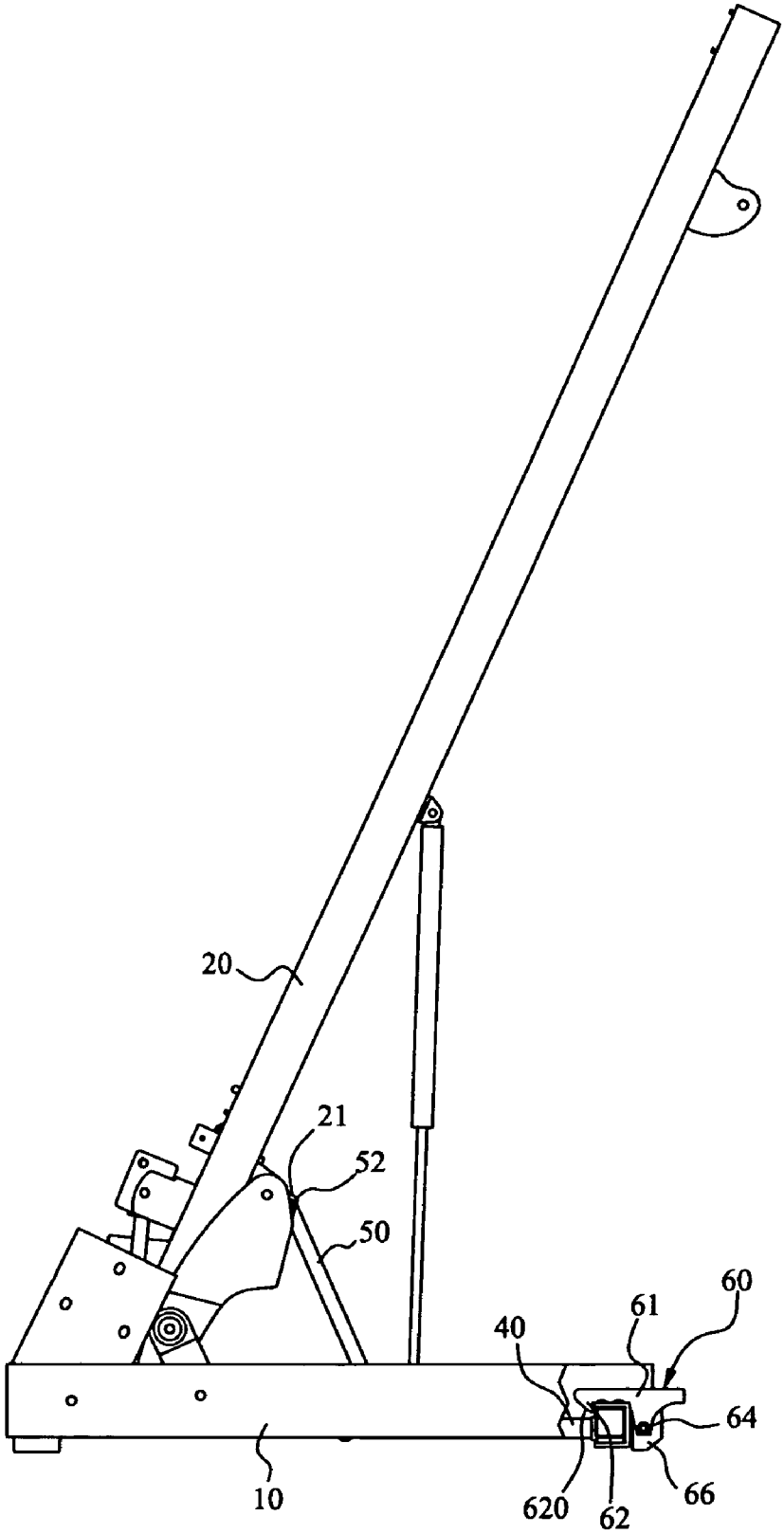
FIG. 8 is a side view to show the engagement of the engaging member and the base.
Figure 9:
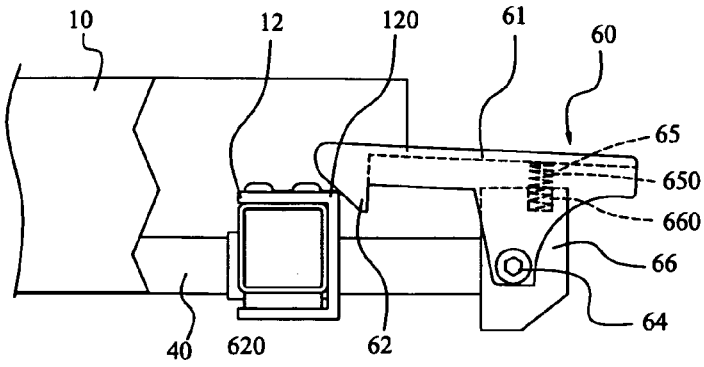
FIG. 9 shows that the hook end is in contact with a front edge of the hooked area of the base.
Figure 10:
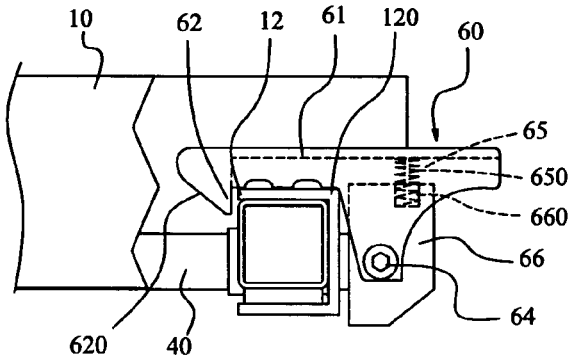
FIG. 10 shows that the hook end is hooked with the hooked area of the base.

As shown in FIGS. 4, 5 and 9, when folding the frame 20 relative to the base 10, the sleeve 40 moves toward the first end of the frame 20 and the outer inclined surface 620 of the front end of the hook end 62 of the engaging member 61 contacts the front edge 120 of the hook area 12. The engaging member 61 is then pivoted about the pin 64 clockwise to compress the compression spring 650. Referring to FIGS. 7, 8 and 10, when keeping on moving the engaging member 61, the outer inclined surface 620 of the engaging member 61 moves over the front edge 120 and the compression spring 650 pushes the first end of the engaging member 61 to hook the hook end 62 to the hooked area 12 of the base 10. Therefore, the sleeve 40 cannot move backward and the supporting rod 50 connected to the sleeve 40 is secured, such that the frame 20 can be supported at upright position.

Figure 6:
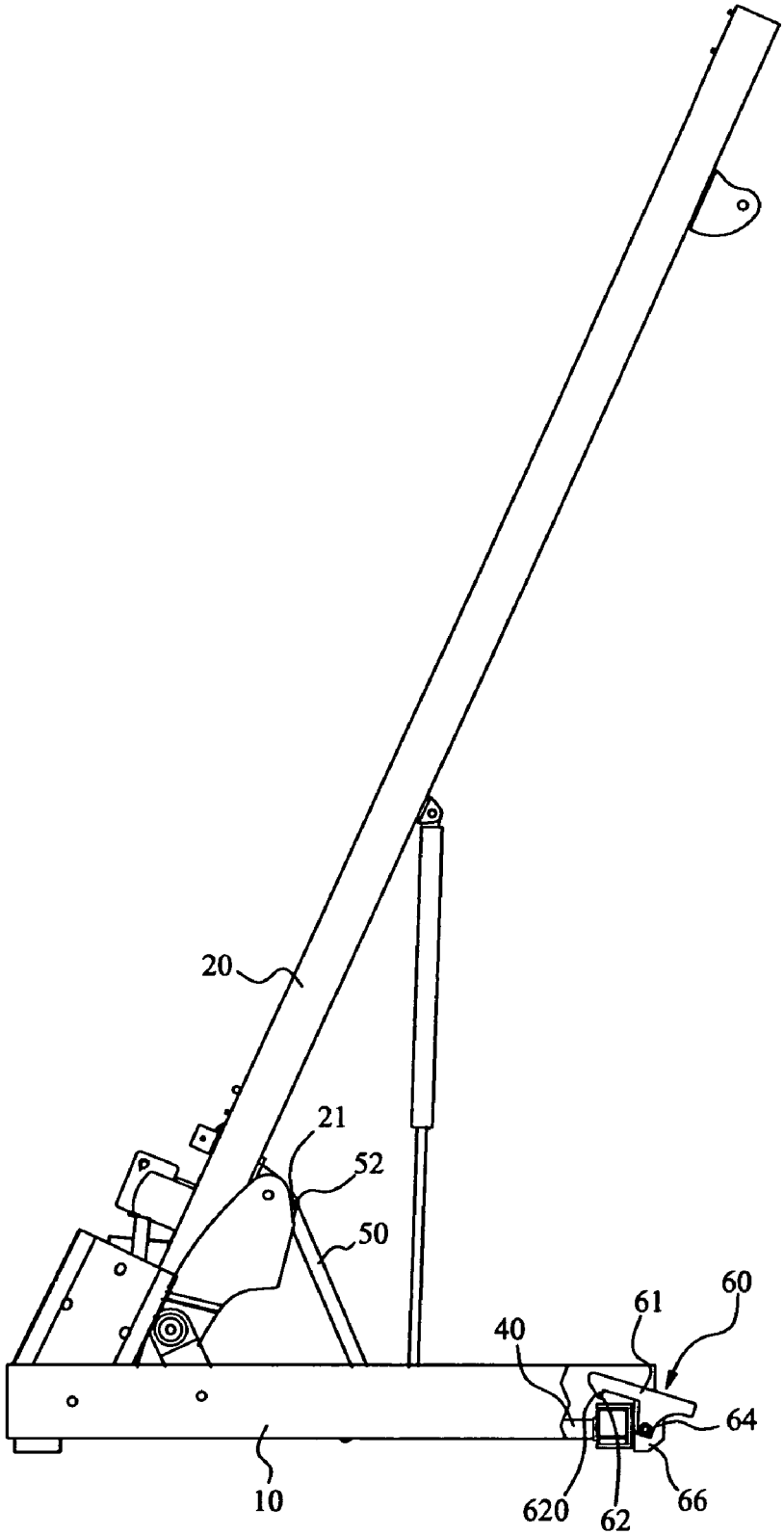
FIG. 6 is a side view of the treadmill in FIG. 5.
Figure 11:
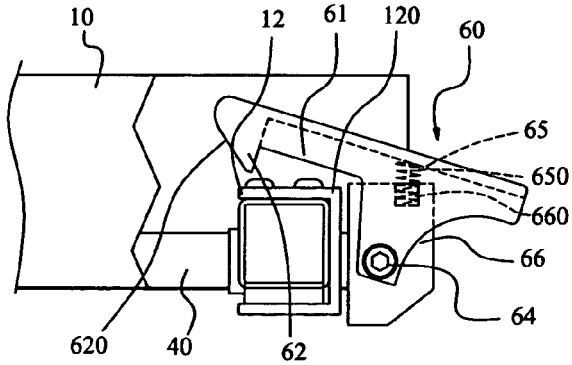
FIG. 11 shows the engaging member is pivoted by the user to disengage the hook end from the hooked area.
Figure 12:
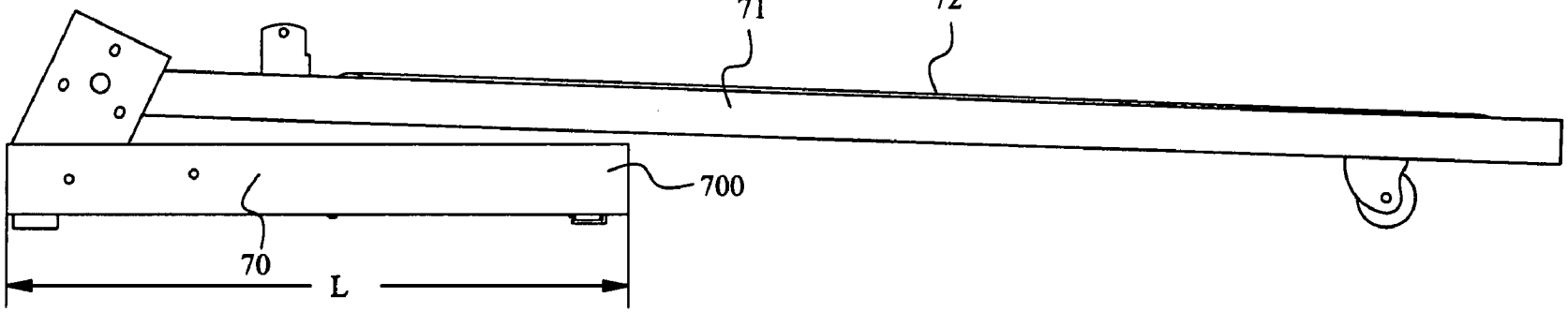
PRIOR ART FIG. 12
FIG. 12 is a side view to show a conventional treadmill.

As shown in FIGS. 6 and 11, when the user steps the first end of the engaging member 61 downward, the engaging member 61 is pivoted about the pin 64 clockwise to disengage the hook end 62 from the hooked area 12, and the sleeve 40 moves backward along the guide rod 30 by the weight of the frame 20 which is then lowered clockwise. The extension of the sleeve 40 within the area of the frame 20 increases the effective length of the base 10 so that the base 10 is more stable.

While we have shown and described the embodiment in accordance with the present invention, it should be clear to those skilled in the art that further embodiments may be made without departing from the scope of the present invention.

What is claimed is:

1. A treadmill comprising:

a base having a through hole;

a frame having a first end thereof pivotably connected to the base and having a first pivotal portion;

an endless belt connected to the frame;

a guide rod having its axis extending lengthwise of the frame and a first end of the guide rod non-pivotably fixed to the base, a second end of the guide rod non-pivotablt connected to the base at a position corresponding to the through hole;

a sleeve extending through the through hole of the base and the guide rod inserted in the sleeve which moves along the guide rod back and forth, the sleeve having a second pivotal portion and the sleeve does not pivot relative to the base;

a supporting rod having a first terminal end thereof pivotably connected to the second pivotal portion on the sleeve, a second terminal end of the supporting rod pivotably connected to the first pivotal portion of the frame; and a securing device connected to the sleeve and movable along with the sleeve so as to secure movement of the sleeve relative to the guide rod, the securing device including an engaging member which is pivotably connected to the sleeve by extending a pin though a hole defined in a first end of the engaging member and a second hole defined in the sleeve, the engaging member having a hook end at a second end thereof, a resilient member located between the engaging member and the sleeve so as to provide a force to lift the second end of the engaging member, and so that the hook end of the engaging member is capable of detachably securing to a hooked area in the base.

2. The treadmill as claimed in claim 1, wherein a positioning member is connected to the sleeve and has a chamber defined therein, the resilient member is a compression spring and a first end of the compression spring is received in the chamber and a second end of the compression spring is in contact with the first end of the engaging member.

3. The treadmill as claimed in claim 1, wherein the guide rod is a cylindrical rod and the sleeve has a circular inner periphery so that the guide rod is movably inserted in the sleeve.

4. The treadmill as claimed in claim 1, wherein a box is connected to the base and the though hole is defined though the box.

5. The treadmill as claimed in claim 1, wherein two rollers are connected to two ends of the frame and the endless belt reeves though the two rollers.

* * * * *